US006575798B2

(12) United States Patent
Maurel

(10) Patent No.: US 6,575,798 B2
(45) Date of Patent: Jun. 10, 2003

(54) DEVICE FOR ATTACHING A FLEXIBLE LINEAR ELEMENT TO AN INFLATABLE TUBE OF AN INFLATABLE CRAFT

(75) Inventor: Didier Maurel, Fonsegrives (FR)

(73) Assignee: Zodiac International (FR)

( * ) Notice: Subject to any disclaimer, the term of this patent is extended or adjusted under 35 U.S.C. 154(b) by 0 days.

(21) Appl. No.: 10/078,753

(22) Filed: Feb. 19, 2002

(65) Prior Publication Data

US 2002/0119714 A1 Aug. 29, 2002

(30) Foreign Application Priority Data

Feb. 21, 2001 (FR) ..... 01 02342

(51) Int. Cl.[7] ..... B63B 1/00

(52) U.S. Cl. ..... 441/75; 114/343; 114/345; 410/101

(58) Field of Search ..... 441/75, 40; 114/343, 114/345

(56) References Cited

U.S. PATENT DOCUMENTS 2,661,704 A * 12/1953 Johnson ..... 410/112
2,870,733 A 1/1959 Winther
4,807,554 A * 2/1989 Chi-Hung ..... 114/345
4,877,361 A * 10/1989 DeRosa et al. ..... 410/112
6,241,440 B1 * 6/2001 Orlebeke ..... 410/106

FOREIGN PATENT DOCUMENTS

| | | |
|---|---|---|
| AU | 374757 | 5/1984 |
| FR | 2754237 | 4/1998 |
| GB | 994463 | 6/1965 |
| GB | 1548456 | 7/1979 |
| GB | 2088713 | 6/1982 |

* cited by examiner

*Primary Examiner*—Jesus D. Sotelo
(74) *Attorney, Agent, or Firm*—Dean W. Russell; Kilpatrick Stockton LLP

(57) ABSTRACT

A device (1) for attaching a flexible linear element to an inflatable tube of an inflatable craft comprising a stud (2) in the shape of a spherical cap with a discoidal mounting base (3) and with a through passage (4) with a cylindrical central channel (5) extended on both sides by two flattened slots (6), this passage (4) emerging in a cavity (7) formed in the stud (2); the end of the flexible linear element (18,29) is made fast to a locking peg (19) that engages with a wedge action in the central channel (5); the locking peg (19) comprises a shank (20) made up of two axial parts (21,22) capable of gripping the end of the flexible linear element and an enlarged head (26) integral with an axial part (21,22) and capable of engaging in the cavity (7) to form a fastening.

10 Claims, 3 Drawing Sheets

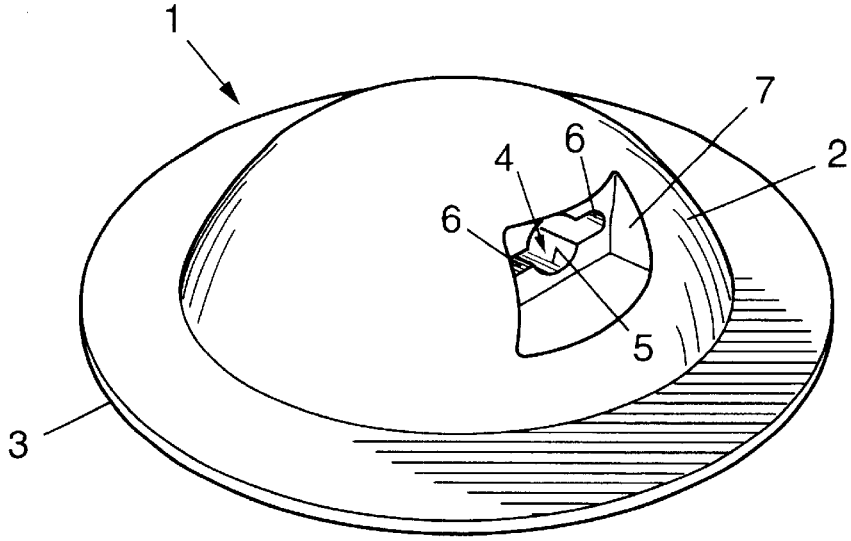
FIG. 1
FIG. 2
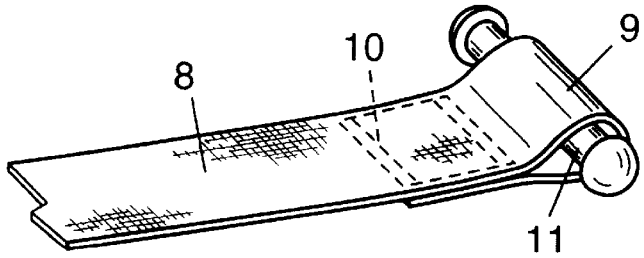
FIG. 3a
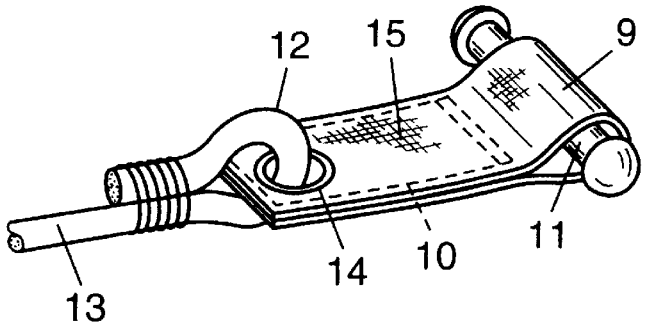
FIG. 3b
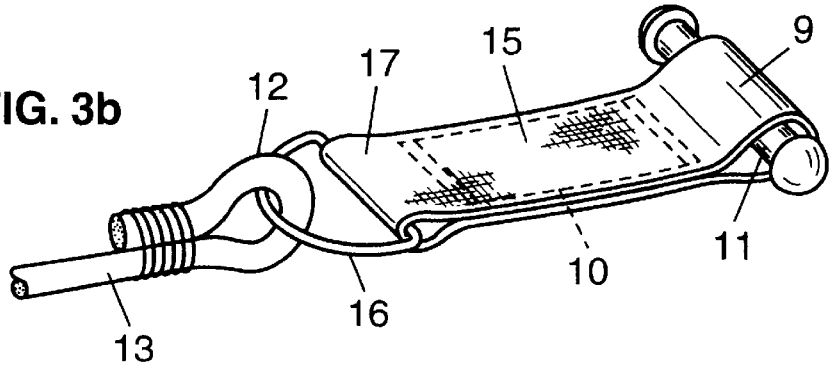

DEVICE FOR ATTACHING A FLEXIBLE LINEAR ELEMENT TO AN INFLATABLE TUBE OF AN INFLATABLE CRAFT

This application claims priority to French Application No. 0102342 filed on Feb. 21, 2001, the entire contents of which are incorporated by reference herein.

1. Field of the Invention

The present invention relates to improvements to devices for attaching a flexible linear element or link to an inflatable tube of a pneumatic craft.

2. Description of the Prior Art

It is known to attach to an inflatable tube of an pneumatic craft a flexible linear element or link that may have a variety of uses: for example a halyard or a length of untensioned webbing serving as a handrail, or webbing tensioned between fastening end points and serving to tension the tube (see particularly document FR 2 734 233).

The flexible linear element or link is supported on the tube by endmost attachment devices for making it fast and optionally by intermediate fastening devices through which the flexible linear element passes.

Attachment devices consisting of shaped studs of unusual aesthetic appearance are known currently. An attachment device of this type is illustrated in document FR 2 754 237, in FIGS. 2 and 3 thereof. In that document the attachment device had the function of a pivoting support for an oar (or rowlock) which does not have to be specifically taken into account in the context of the present invention. Consequently, referring to FIG. 1 of the drawings appended to the present application, the known attachment device, designated as a whole by the reference number 1, comprises a stud 2 in the general shape of a spherical cap with a discoidal base 3 for attachment (e.g. by welding or bonding) to the inflatable tube. The stud 2 comprises a through passage 4 made in the form of a central channel that is essentially a cylinder of revolution extended on both sides by two diametrically opposite flattened slots 6. Moreover, at least one end of the passage 4 emerges, not directly on the surface of the spherical cap defining the stud 2 but at the bottom of a cavity 7 recessed into the said surface, as shown in FIG. 1.

An attachment device having such a construction can be traversed both by a halyard or cord of approximately cylindrical section, engaged in the central channel 5, and by webbing in the form of a ribbon engaged in the flattened slots across the channel 5.

For fastening the end of a length of webbing 8, a terminal loop 9 is formed, as illustrated in FIG. 2, by folding the end back on itself (sewn at 10 and/or bonded); this loop 9 is engaged through the passage 4 and out of the cavity 7; a locking pin 11 is placed in the loop; and finally the webbing 8 is pulled until the locking pin 11 is bearing against the cavity 7 to retain the webbing 8.

The double thickness of webbing sewn together at 10 behind the loop 9 remains thin enough to be able to be engaged in the slots 6 of the passage 4.

However, this cannot be said for the fastening of a halyard, whose diameter is only slightly less than that of the central channel 5 of the passage 4: it is therefore impossible to form, on the end of the halyard, a loop to take the locking pin 11, because the double thickness of halyard resulting from the formation of the loop would not fit inside the central channel 5.

Consequently another type of attachment is used, two examples of which are shown in FIGS. 3A and 3B.

In FIG. 3A a loop 12 is formed at the end of halyard 13. This loop passes through an eye 14 in a length of webbing 15 whose length corresponds approximately to the length of the passage 4 through the stud 2. The end of the length of webbing 15 is shaped into a loop 9 suitable to enclose the pin 11, in an arrangement similar to that of FIG. 2.

In FIG. 3B, the loop 12 at the end of the halyard 13 passes through a D ring 16 which is retained in a terminal loop 17 of a length of webbing 15, at the other end of which is the loop 9 containing the pin 11, as before.

In both cases the presence in the stud 2 of the cavity 7, with the locking pin 11 inside it as a fastening for a length of webbing, is unaesthetic. The provision of a removable cover suitable for closing the cavity 7 and shaped externally to give continuity to the shape of the stud would admittedly solve this problem. However, such a cover would be easily lost, and it would be necessary to provide snap-fastening means for the cover and the cavity walls, which would result in a complication of the shapes and therefore of the process of manufacture of the parts.

In addition, the mounting that has to be resorted to when attaching a halyard is again unattractive to the eye. Also, it requires multiple component parts, the manufacture and assembly of which are expensive.

SUMMARY OF THE INVENTION

It is therefore an object of the invention to provide a simple technical solution which, without modifying the attachment device or the shape of the passage running through the stud, will allow correct fastening of both webbing and a halyard without the use of an excessive number of additional parts; above all, the invention seeks to provide a technical solution of attractive appearance.

It should be stressed here that the aesthetic appearance of the attachment devices to which the invention relates is not negligible because, being located on top of the tubes of the inflatable craft, they are very visible. Moreover the inflatable craft in question are essentially targeted at the general public, who are very sensitive to the aesthetic qualities of the equipment presented to them.

An additional point to be stressed is that it can be desirable to give a stud an entirely smooth contour by closing off the cavity 7 not only to improve its appearance but also for reasons of safety, in order to prevent accidental snagging of equipment or clothing in this cavity.

For these purposes, the invention provides a device for attaching a flexible linear element to an inflatable tube of an inflatable craft, comprising a stud in the general shape of a spherical cap with a discoidal base for attachment to the inflatable tube, this stud comprising a through passage with a central channel that is substantially a cylinder of revolution extended on both sides by two flattened slots, the said passage emerging, at at least one end, in a cavity recessed into the stud, which device, being constructed in accordance with the invention, is characterized in that the end of the flexible linear element is made fast to a locking peg that is capable of being engaged with a wedge action in the abovementioned central channel of the through passage of the stud, and in that the said locking peg comprises, on the one hand, a shank made up of two axial parts capable of gripping the end of the flexible linear element and holding it mechanically, and, on the other hand, an enlarged head integral with at least one of the axial parts and capable of being engaged in the said cavity of the stud to form a fastening.

In a preferred embodiment, one of the axial parts of the shank of the locking peg comprises a flat longitudinal section with at least one tooth projecting transversally and capable of being engaged in a corresponding hole passing through the flexible linear element and the other axial part of the shank comprises a flat longitudinal section with at least one recess or a through hole capable of receiving the end of the said projecting tooth; advantageously, the first axial part of the shank of the locking peg comprises two projecting teeth arranged axially one after the other and capable of being engaged, through two axially successive holes formed in the flexible linear element, into two corresponding recesses or holes in the other axial part of the shank.

For good insertion and locking, it is advantageous if the external longitudinal profile of the shank of the locking peg is slightly conical from its end towards its base to produce a clamping effect on the flexible linear element and wedging it when engaged in the central channel of the through passage of the stud.

It is then easy for the cavity of the stud and the enlarged head of the peg to have complementary shapes so that the enlarged head fits geometrically into the cavity and for the enlarged head to be shaped externally to complete the external shape of the stud.

In accordance with a first possible use of the attachment device according to the invention, the flexible linear element is a halyard whose cross section is approximately that of a cylinder of revolution, its end being engaged in the central channel of the said through passage of the stud; advantageously then, the end of the halyard is crushed and flattened and the hole or holes are made in the flattened portion at right angles thereto; or alternatively, the halyard is braided and the hole or holes are natural passages, enlarged if necessary, in the braiding.

In accordance with another possible use of the attachment device of the invention, the flexible linear element is a flat length of webbing whose end is engaged through the central channel and in the slots on either side of the latter.

By means of the arrangements according to the invention, the end of the flexible linear element or link is used in a single thickness, which means that it will fit into the through passage of the stud whether it is halyard or webbing. Additionally, because it is designed as a clamp with a taper fit into the central channel of the through passage of the stud, the terminal member fastened to the end of the flexible linear element provides for robust retention and its grip actually improves if the flexible linear element is pulled from the other side, thus increasing its safety.

Lastly, on the basis of these arrangements, it is not complicated to shape the abovementioned enlarged head in such a way that it closes the cavity and in such a way that it gives continuity of shape to the outer surface of the stud. The result is a much improved appearance while at the same time the risk of objects snagging in the cavity is eliminated. Also, the closure described herein for the cavity cannot be lost because it is integral with the flexible linear element and merely locks more firmly into the cavity if the flexible linear element is pulled from the other side.

Also, and this is no small advantage, the fastening parts are simple to manufacture (they can be moulded in plastic) and there are few of them, so that the cost of these parts is very low.

BRIEF DESCRIPTION OF THE DRAWINGS

A clearer understanding of the invention will be gained from reading the following detailed description of certain preferred embodiments given purely by way of non-restrictive example. This description refers to the attached drawings, in which.

DETAILED DESCRIPTION OF THE INVENTION

Figure 4:
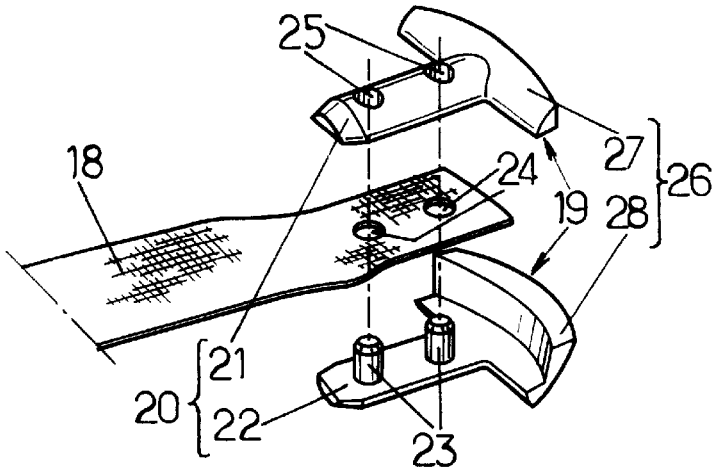
FIG. 4 is an exploded perspective view of part of an attachment device in accordance with the invention together with the end of a webbing.

Turning first to FIG. 4, a locking peg 19 capable of being wedged into the channel 5 of the through passage 4 of the stud 2 is attached to the end of a flexible linear element or link (a webbing 18 in FIG. 4).

The locking peg 19 comprises a shank 20 made up of two axial parts (or half-shanks) 21 and 22 each designed to grip the end of the webbing 18 and hold it mechanically in any appropriate way. Reliefs (grooves, diamond points, etc.) on the opposing faces of the two axial parts 21,22 could provide the desired mechanical retention effect. However, to provide a reliable coupling even if the webbing comes under heavy traction, it is preferred to use one or more (two in the example illustrated) teeth 23 projecting transversely from one 22 of the axial shank parts; these teeth 23 pass through corresponding holes 24 formed in the webbing 18 and fit into the corresponding recesses or holes 25 in the other axial shank part 21.

The locking peg 19 also includes an enlarged head 26 consisting either of a single part integral with one of the axial shank parts (an example will be given later), or of two parts 27,28 integral with the two axial shank parts 21,22, respectively, as illustrated in FIG. 4.

The axial shank parts 21,22 and the head parts 27,28 have, as illustrated in FIG. 4, a roughly semi circular cross section and, when assembled, fit together at their respective flat faces. The teeth 23 thus project transversely with respect to the flat face of the axial shank part 22.

Figure 6:
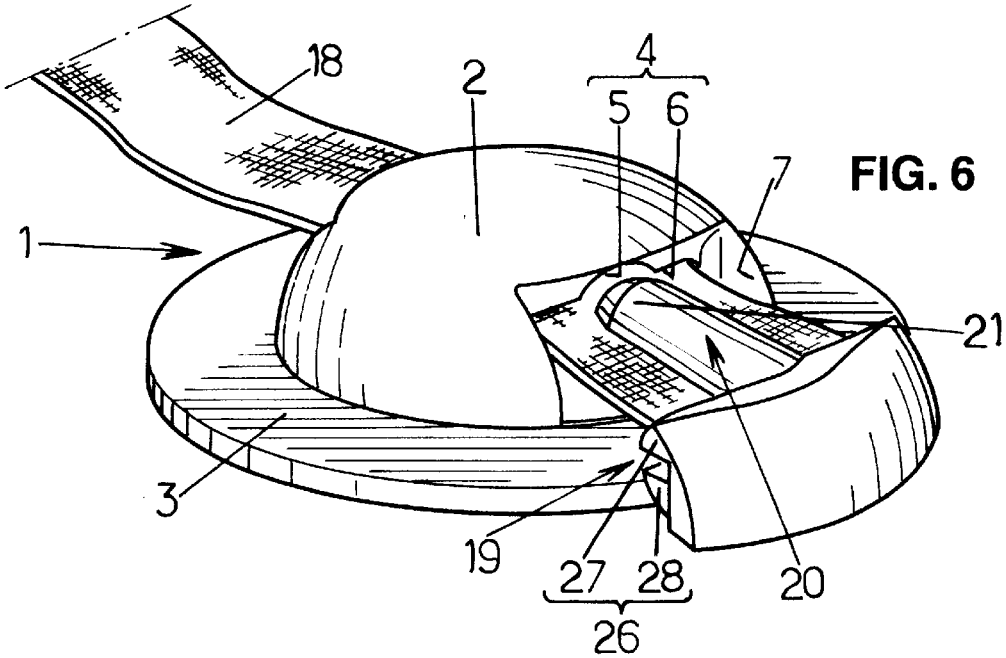
FIG. 6 shows the part of the attachment device seen in FIG. 4 partly inserted into the stud shown in FIG. 1.

The external shape of the shank 20 is determined by the shape of the central channel 5 of the through passage 4 into which it is intended to be driven. The diameter of the shank 20 is preferably slightly smaller than the inside diameter of the central channel 5 in order that, when the axial parts 21,22 grip the end of the webbing 18, the shank 20 has to be driven with some force into the central channel 5, as illustrated in FIG. 6 (where the locking peg 19 is illustrated in position in the stud 2, but partly out of the through passage 4).

It is also possible for the external longitudinal profile of the shank 20 of the locking peg 19 to be slightly conical, becoming wider from its end towards its base so as to provide an enhanced clamping action on the webbing 18 when the shank 20 is engaged forcibly in the central channel 5.

Figure 5:
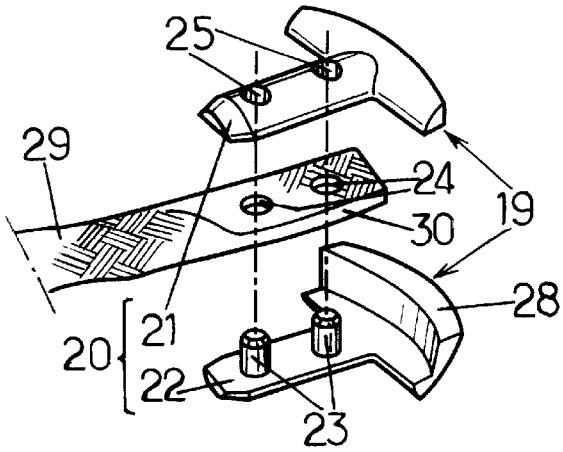
FIG. 5 is an exploded perspective view of the same part of the attachment device as in FIG. 4 together with the end of a halyard.

FIG. 5 illustrates the application of the provisions of the invention in a case in which the flexible linear element or link is a halyard 29. The component parts of the locking peg 19 remain as described above and shown in FIG. 4. The halyard 29 likewise has two holes 24 designed to take the teeth 23. However, to facilitate the fitting of the flat faces of the axial shank parts 21,22 to the halyard (which is generally circular in cross section), it is advantageous to flatten the end of the halyard as illustrated at 30 in FIG. 5: flattening can be done either by crushing the end of the halyard or by a special lay. The holes 24 are then made in the flattened end 30, at right angles to this flattening. Alternatively, or in combination, the halyard 29 being braided as illustrated in FIG. 5, the holes 24 may actually be formed by natural passages through the braiding, these natural passages being enlarged if necessary to suit requirements.

Figure 8:
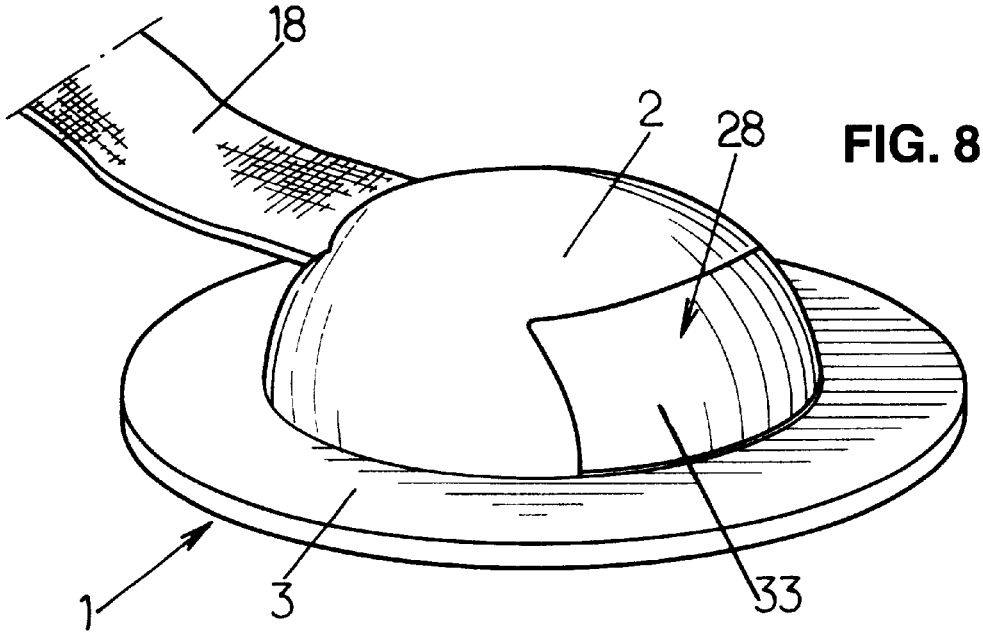
FIG. 8 shows the preferred embodiment of FIG. 7 in its functional position in the stud seen in FIG. 1.

In a preferred embodiment of the locking peg of the invention, the enlarged head 26 of the locking peg 19 is shaped in such a way that it not only bears against the inner wall of the cavity 7, but also forms a cap that closes the said cavity 7 and provides continuity of the outer surface of the stud 2. To this end, one of the head parts, for example the part 28 connected to the axial shank part 22 supporting the projecting teeth 23, is produced with a flat 31 bounded at the outside by a transverse wall 32 whose shape and dimensions are such as to closely match the contour of the cavity 7. Furthermore, its outer surface 33 is in the form of a portion of a spherical cap so that there is continuity of the outer surface of the stud 2, as illustrated in FIG. 8.

Figure 7:
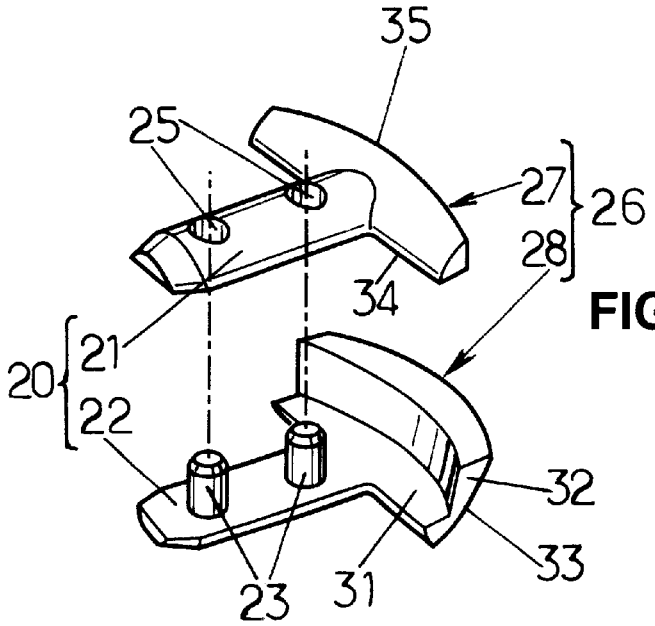
FIG. 7 is an exploded perspective view of a preferred embodiment of the part of the attachment device shown in FIG. 4.

As to the other component part of the locking peg 19, this possesses a head part 27 with a lower flat 34 designed to be placed against the flat 31 of the aforementioned head part 28. Moreover, at right angles to the flat 34 it has a face 35 (curved in the illustration, FIG. 7) which closely matches the form of the abovementioned transverse wall 32.

When assembled, the head part 27 fits exactly into the shoulder defined in the head part 28. This contributes to the rigidity of the locking peg 19.

In this way, owing to the provisions of the invention, the flexible linear element or link is held in the stud by its simple (that is to say not looped) end. If the flexible linear element is the halyard 29 of FIG. 5, the halyard 29 is engaged in the central channel 5 of the through passage 4. If the flexible linear element is the webbing 18 of FIGS. 4 and 6, the webbing 18 is engaged across the central channel 5 and into the slots 6 on either side of it.

What is claimed is:

1. A device for attaching a flexible linear element or link to an inflatable tube of a pneumatic craft, comprising a stud in the general shape of a spherical cap with a discoidal base for attachment to the inflatable tube, this stud comprising a through passage with a central channel that is substantially a cylinder of revolution extended on both sides by two flattened slots, the said passage emerging, at at least one end, in a cavity recessed into the stud, wherein the end of the flexible linear element is made fast to a locking peg that is capable of being engaged with a wedge action in said central channel of the through passage of the stud, and wherein said locking peg comprises, on the one hand, a shank made up of two axial parts capable of gripping the end of the flexible linear element and holding it mechanically and, on the other hand, an enlarged head integral with at least one of the axial parts and capable of being engaged in the said cavity of the stud to form a fastening.

2. A device according to claim 1, wherein one of the axial parts of the shank of the locking peg comprises a flat longitudinal section with at least one tooth projecting transversally and capable of being engaged in a corresponding hole passing through the flexible linear element and wherein the other axial part of the shank comprises a flat longitudinal section with at least one recess or a through hole capable of receiving the end of said projecting tooth.

3. A device according to claim 1, wherein the external longitudinal profile of the shank of the locking peg is slightly conical from its end towards its base to produce a clamping effect on the flexible linear element and wedging it when engaged in the central channel of the through passage of the stud.

4. A device according to claim 2, wherein the first axial part of the shank of the locking peg comprises two projecting teeth arranged axially one after the other and capable of being engaged, through two axially successive holes formed in the flexible linear element, into two corresponding recesses or holes in the other axial part of the shank.

5. A device according to claim 1, wherein the cavity of the stud and the enlarged head of the peg have complementary shapes so that the enlarged head fits geometrically into the cavity and in that the enlarged head is shaped externally to complete the external shape of the stud.

6. A device according to claim 1, wherein the flexible linear element is a halyard whose cross section is approximately that of a cylinder of revolution, its end being engaged in the central channel of the said through passage of the stud.

7. A device according to claim 6, wherein the end of the halyard is crushed and flattened and in that the hole or holes are made in the flattened portion at right angles thereto.

8. A device according to claim 6, wherein the halyard is braided and in that the hole or holes are natural passages through the braiding.

9. A device according to claim 1, wherein the flexible linear element is a flat length of webbing whose end is engaged through the central channel and in the slots (6) on either side of the latter.

10. A pneumatic craft comprising at least one inflatable tube equipped with at least one attachment device capable of securing a flexible linear element such as a length of webbing or a halyard, wherein said attachment device is constructed in accordance with claim 1.

* * * * *